US008918927B1

(12) United States Patent
Smith

(10) Patent No.: US 8,918,927 B1
(45) Date of Patent: Dec. 30, 2014

(54) MULTIPLE PIECE SHOWER STALL

(75) Inventor: John A. Smith, Windermere, FL (US)

(73) Assignee: Oasis Lifestyle, LLC, Plymouth, IN (US)

( * ) Notice: Subject to any disclaimer, the term of this patent is extended or adjusted under 35 U.S.C. 154(b) by 1037 days.

(21) Appl. No.: 12/892,365

(22) Filed: Sep. 28, 2010

(51) Int. Cl.
*A47K 3/00* (2006.01)

(52) U.S. Cl.
USPC ..... 4/619

(58) Field of Classification Search
CPC ..... A47K 3/284; A47K 3/283
USPC ..... 4/612–614
See application file for complete search history.

(56) References Cited

U.S. PATENT DOCUMENTS

| | | | | |
|---|---|---|---|---|
| 4,080,710 | A * | 3/1978 | Hess | 29/416 |
| 4,553,276 | A | 11/1985 | Paradis | |
| 4,720,876 | A | 1/1988 | Tomei et al. | |
| 4,970,734 | A | 11/1990 | Friedman et al. | |
| 4,987,619 | A | 1/1991 | Smith | |
| 5,023,965 | A | 6/1991 | Reichel | |
| 5,097,543 | A | 3/1992 | Oille | |
| 5,370,582 | A | 12/1994 | Campbell | |
| 2010/0101013 | A1 | 4/2010 | von Obstfelder | |

FOREIGN PATENT DOCUMENTS

| | | |
|---|---|---|
| DE | 4217972 A1 | 12/1993 |
| EP | 0193905 A2 | 9/1986 |

OTHER PUBLICATIONS

Aqua Glass Corporation, Aqua Glass: Installation Instructions for Acrylic and Gelcoat Tub/Shower and Shower Units, Undated, 4 pages.
Lasco Bathware, Lasco Bathware: Installation Data Remodeline (Section Units), 2004, pp. 1-4.
Maax Bath Inc, Aker by Maax: Installation Guide, 2008, pp. 1-12.
Maax Bath Inc., Maax: Installation Instructions and User Guide Alcove Shower, 2008, 24 pages.
Maax Bath Inc., Keystone by Maax Urbano 4832, undated, 3 pages.
Maax Bath Inc., Keystone by Maax Urbano 6032, undated, 3 pages.

* cited by examiner

*Primary Examiner* — Huyen Le
(74) *Attorney, Agent, or Firm* — Barnes & Thornburg LLP

(57) ABSTRACT

A multiple piece shower stall assembly including a base and at least one wall section for mounting on the base. The base and the wall section each include a plurality of corresponding sidewalls. An interface between the base and the wall section includes a first ledge extending outwardly from the base sidewalls, a second ledge extending outwardly from the wall section sidewalls, and a plurality of connectors configured to join the first ledge and the second ledge.

29 Claims, 3 Drawing Sheets

MULTIPLE PIECE SHOWER STALL

BACKGROUND AND SUMMARY

The present invention relates to a multiple piece shower stall. In particular, a shower stall having more than one separate section configured to be stacked together to form a complete assembly. More particularly, each section of the shower stall includes an interface for joining adjacent sections. The interface includes a plurality of connectors configured to provide a positive connection between the two sections.

Pre-formed shower stalls and enclosures are formed from water-resistant materials like fiberglass, plastic, acrylic and other suitable materials and can be installed over water-resistant wallboard or another substrate. A pre-formed shower stall or enclosure needs only to be brought into the desired position and secured in place. In certain situations, it may be desirable to provide a multiple piece shower stall having multiple sections that can be individually positioned and assembled into a complete enclosure.

According to one embodiment of the present invention, a multiple piece shower stall assembly includes a base, a first wall section, a second wall section, a first interface between the base and the first wall section and a second interface between the first wall section and the second wall section. The base includes a floor and a plurality of sidewalls extending upwardly from the floor. The first wall section includes a plurality of sidewalls corresponding to the plurality of sidewalls of the base and the second wall section includes a plurality of sidewalls corresponding to the plurality of sidewalls of the first wall section. The first interface includes a first ledge extending outwardly from the top of the sidewalls of the base and terminating in a first upwardly projecting flange, a second ledge extending outwardly from the bottom of the sidewalls of the first wall section and a plurality of connectors configured to join the first ledge and the second ledge. The second interface includes a third ledge extending outwardly from the top of the sidewalls of the first wall section and terminating in a second upwardly projecting flange, a fourth ledge extending outwardly from the bottom of the sidewalls of the second wall section and a plurality of connectors configured to join the third ledge and the fourth ledge. Each connector includes a first member connected to one of the first ledge and the third ledge and a second member located within an aperture formed within one of the second ledge and the fourth ledge. The first member has a first section and the second member has a base, a sidewall extending from the base defining a recess and a magnet connected to the base within the recess. The first section of the first member and the second member are configured so that the first section fits within the recess. In one embodiment of the invention, the first section of the first member is made from a magnetic material. The first section of the first member can include a surface configured to contact a surface of the magnet. In another embodiment, the side wall of the second member of the connector is made from a magnetic material.

In another embodiment of the present invention, a multiple piece shower stall assembly includes a base and at least one wall section. The base includes a floor and a plurality of sidewalls extending upwardly from the floor. The wall section includes a plurality of sidewalls corresponding to the plurality of sidewalls of the base section. The assembly further includes an interface between the base section and the wall section, the interface including a first ledge extending outwardly from the sidewalls of the base, a second ledge extending outwardly from the sidewalls of the wall section and a plurality of connectors configured to join the first ledge and the second ledge. At least one connector may include a first member connected to the first ledge and a second member connected to the second ledge. At least one of the first member and the second member can include a threaded section for connecting the member to the first or second ledge. At least one of the first member and the second member may be located within an aperture in the first or second ledge. The second member may include a base and a sidewall extending from the base defining a recess configured to receive a section of the first member. In one embodiment, at least a portion of the base of the second member is located above at least a portion of the first member. The first and/or second members may include a magnet. In one embodiment, coupling the first member and the second member produces an audible sound. In another embodiment, the magnet includes a first surface and the first member includes a second surface configured to be in contact with the first surface of the magnet when the section of the first member is located in the recess of the second member.

BRIEF DESCRIPTION OF THE DRAWINGS

The present disclosure will be described hereafter with reference to the attached drawings which are given as a non-limiting example only, in which.

DETAILED DESCRIPTION

Figure 1:
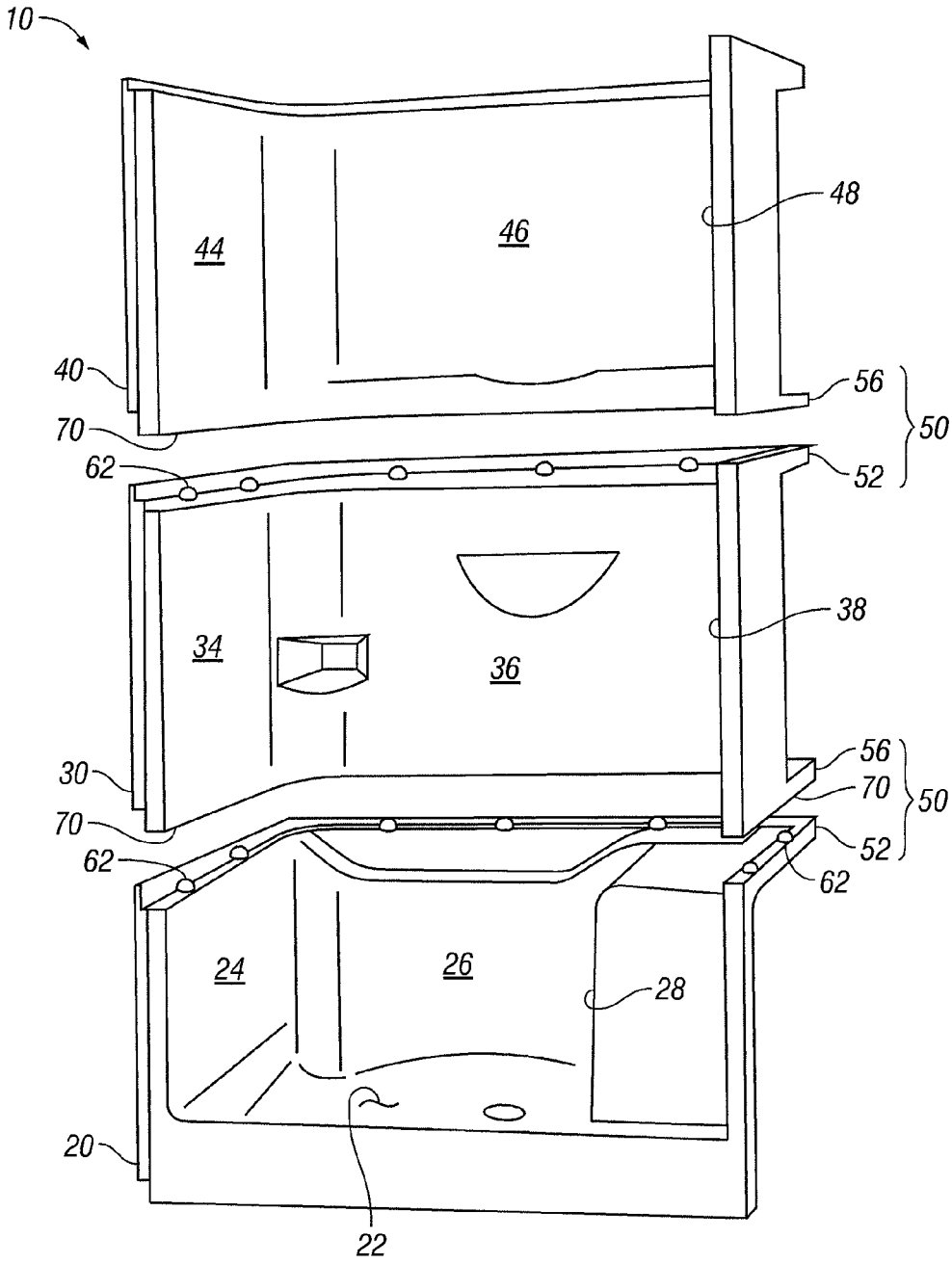
FIG. 1 is a perspective view of an embodiment of a multiple piece shower stall according to one embodiment of the present invention including a base section, a middle section and a top section.

Referring to FIG. 1, a multiple piece shower stall 10 according to one embodiment of the present invention includes two or more separate sections that can be stacked on top of each other and joined, thereby forming a complete shower stall. Note that although FIG. 1 shows a shower stall without a bathtub, the present invention is equally applicable to combined tub and shower stall units. Accordingly, the term "shower stall" as used in the present disclosure is intended to encompass and include both individual shower stalls and combined tub and shower stall units. As shown in the exemplary embodiment, the multiple piece shower stall 10 includes a base 20 having a floor 22 and side walls 24, 26, and 28, extending upwardly from the floor 22, a middle wall section 30 having side walls 34, 36, and 38, and a top wall section 40 having side walls 44, 46, and 48. Sidewalls 24, 26, 28 are configured to align with sidewalls 34, 36, and 38, and sidewalls 34, 36, and 38 are configured to align with side walls 44, 46, and 48, respectively. In the embodiment shown, the side walls of the base 20, middle wall section 30 and top wall section 40 are shown as being integrally formed. In alternative embodiments of the invention, one or more of the side walls of one or more of base 20, middle wall section 30 and top wall section 40 are separate members that are joined with the adjacent side walls of the same section during assembly. For example, sidewalls 34, 36 and 38 of middle wall section 30 can be separate members that are joined to each other during assembly. Furthermore, the sidewalls of base 20, middle wall section 30 and top wall section 40 do not have to be of any particular height. For example, base 20 may be what is commonly referred to as a "shower pan" and have walls of approximately 4-6 inches in height.

It is envisioned that the multiple piece shower stall 10 and its constituent sections 20, 30, 40 disclosed herein be formed from rugged, lightweight, water-resistant materials such as fiberglass, acrylic, plastic, or combinations thereof. Further, sidewalls 24, 26, 28, 34, 36, 38, 44, 46, and 48 may be smooth or textured, flat or contoured defining such features as a seat, shelf, etc.

Figure 2:
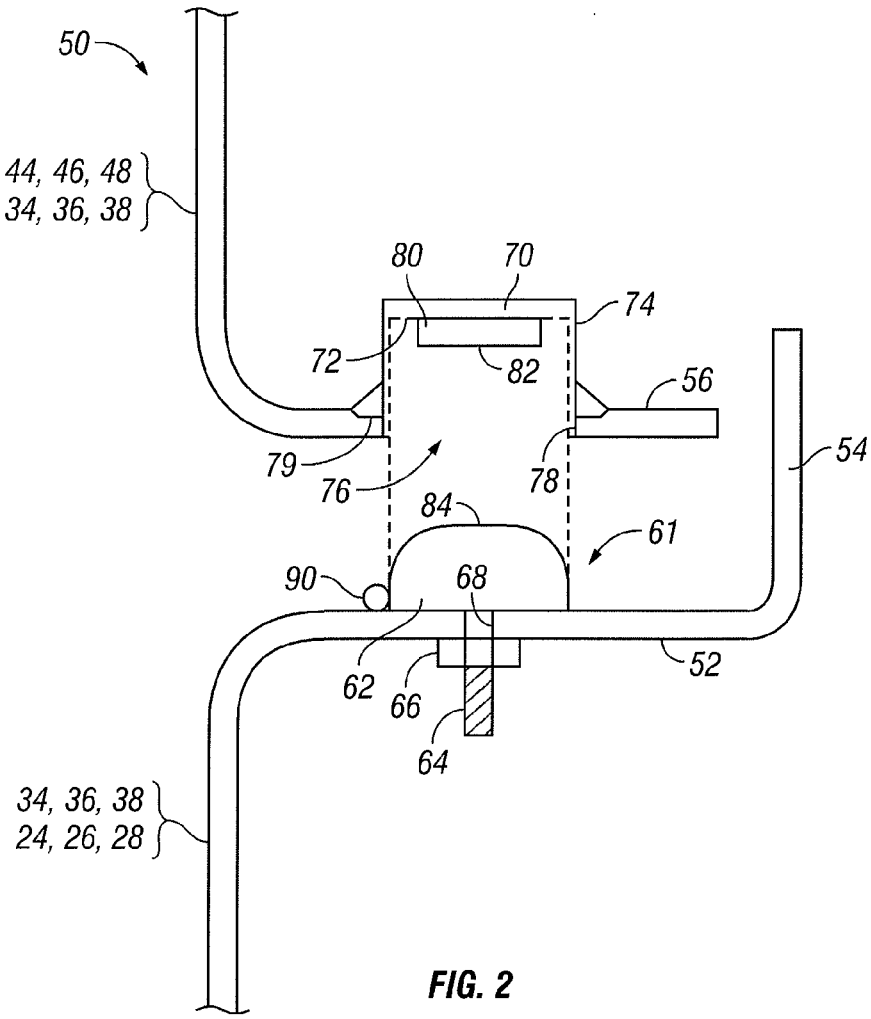
FIG. 2 is a detailed cross-section view of an interface between sections of the multiple piece shower stall shown in FIG. 1.

An interface 50 is provided for securing the middle wall section 30 to the base 20 and for securing the top wall section 40 to the middle wall section 30. Referring to FIG. 2, interface 50 includes a first ledge 52, oriented substantially horizontal and terminating in a substantially vertical attachment flange 54, and a second ledge 56, oriented substantially horizontal and configured to cooperate with the first ledge 52. As shown in the exemplary embodiment, on the base 20, the first ledge 52 extends outwardly from the top of sidewalls 24, 26, and 28. On the middle wall section 30, the first ledge 52 extends outwardly from the top of sidewalls 34, 36, and 38 and the second ledge 56 extends outwardly from the bottom of sidewalls 34, 36, and 38. On the top wall section 40, the second ledge 56 extends outwardly from the bottom of sidewalls 44, 46, and 48.

Figure 3:
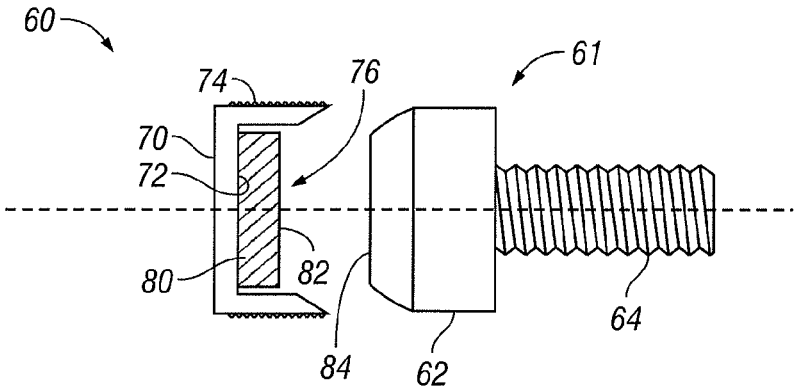
FIG. 3 is a side view of a connector for joining sections of a multiple piece shower stall according to one embodiment of the present invention.

A number of connectors 60 are provided along the interface 50 to join the first ledge 52 and the second ledge 56. Referring to FIGS. 2 and 3, connector 60 includes a first member 61 mounted on the first ledge 52 and a second or receiving member 70 mounted on the second ledge 56. In an exemplary embodiment, first member 61 includes a first or mating section 62 and a threaded stud 64 and nut 66 to secure first section 62 to the first ledge 52 through an aperture 68. A gasket, O-ring, or washer (not shown) may be positioned between section 62 and the upper surface of the first ledge 52 to prevent water or moisture from leaking through aperture 68 during use.

Figure 2A:
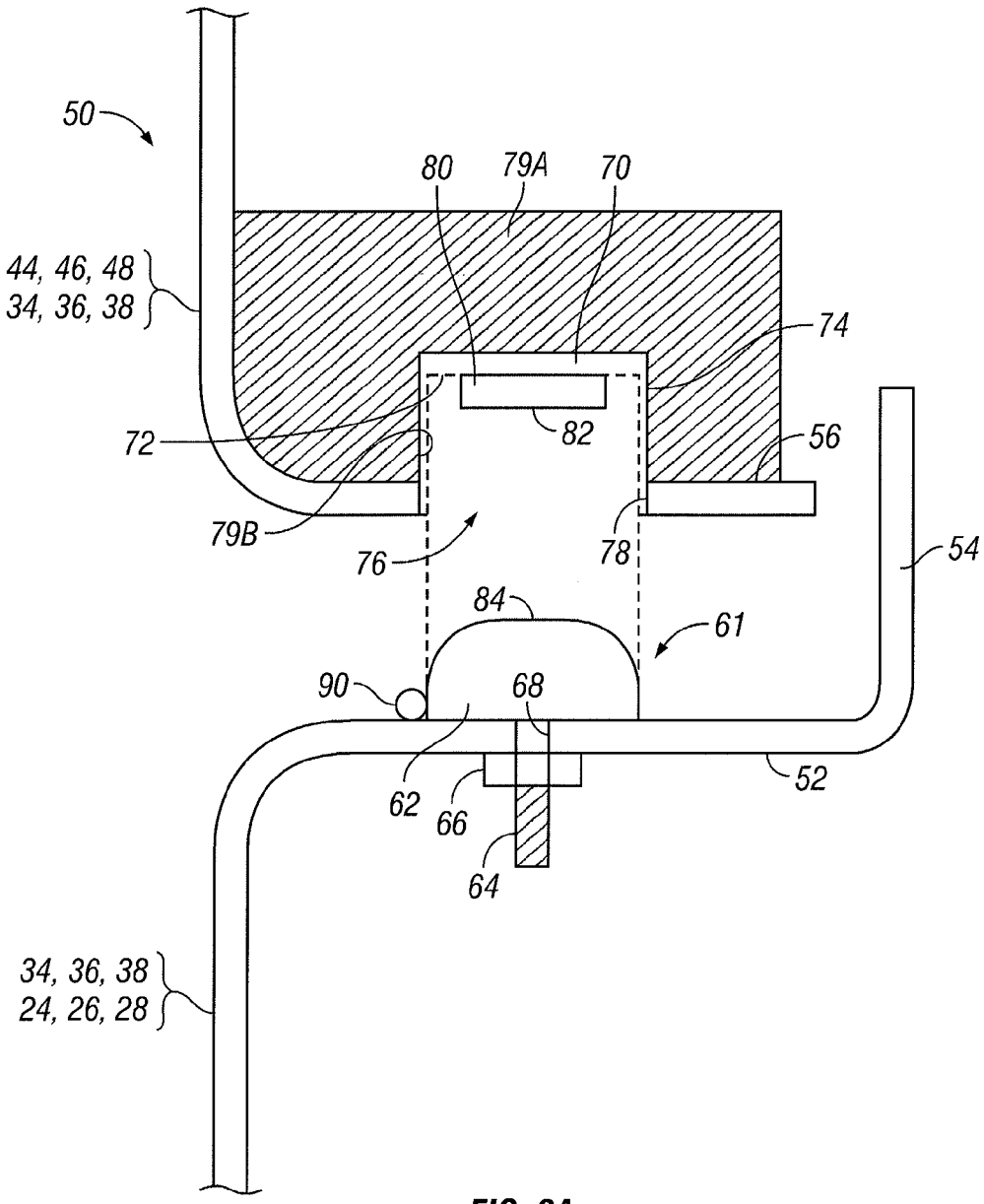
FIG. 2A is a detailed cross-section view of an alternative embodiment of an interface between sections of the multiple piece shower stall shown in FIG. 1.

The second member 70 is a generally cylindrical member including a base 72 and a side wall 74 forming a recess or cavity 76. Second member 70 is mounted in an aperture 78 formed in the second ledge 56. In the exemplary embodiment, the outer surface of sidewall 74 is configured for an interference fit with the inside surface of aperture 78. The outer surface of sidewall 74 may include knurling or other surface features to help secure second member 70 to second ledge 56. Alternatively, epoxy, adhesive, or other means 79 may be utilized alone or in combination with other securing means. FIG. 2A shows an alternative embodiment of the present invention. In this embodiment, a solid member 79A is attached to ledge 56 as shown. A recess 79B is formed in member 79 and second member 70 is press fit or otherwise secured in recess 79B to connect it to ledge 56. In one embodiment of the invention, member 79A includes a wood core encased in a composite fiberglass and resin shell. Member 79A may be secured to ledge 56 by placing the wood core on the wet fiberglass and resin while the shower stall is being constructed. The core is then covered with additional fiberglass and resin material. The cured fiberglass and resin material secures member 79A to ledge 56. Other materials and attachment means may be used for member 79A. As yet another alternative, the outer surface of sidewall 74 may be configured for threaded attachment to second ledge 56, or may be attached by other suitable means. A magnet 80 is attached to the base 72 of second member 70 within the recess 76.

The magnet 80 includes a surface 82 configured to cooperate with a mounting surface 84 on first section 62 for magnetic coupling of first member 61 to second member 70. In the exemplary embodiment, magnet surface 82 and mounting surface 84 are shown as flat planar surfaces. However, the configuration of the magnet surface 82 and the mounting surface 84 may be of any suitable shape that provides adequate contact area for surfaces 82 and 84. Second member 70 receives all or part of first section 62 in a mating relationship. Connector 60 provides a positive magnetic force that locks the sections of the multiple piece shower stall together. Further, as second member 70 is guided over first section 62, surfaces 82 and 84 are drawn together by magnetic force such that the mating of surfaces 82 and 84 produces an audible "click" sound, alerting an installer that the sections have been properly mounted.

In one embodiment of the invention, it is desirable that the first member 61 and magnet 80 cooperate to produce a force of at least approximately 14 pounds when surfaces 82 and 84 are in full contact. A grade 45 neodymium magnet has been found to be suitable for this purpose, although other magnets can also be used. First section 62 may be formed from any magnetic material such as iron or carbon steel. Second member 70 may also be formed from a magnetic material. In this manner, magnet 80 will magnetize base 72 and side wall 74 of second member 70. A rust-resistant coating such as a powder coating, ceramic, porcelain, plastic, acrylic, or other suitable coating may be applied to the first section 62 and second member 70 to encapsulate the steel. Further, although the positions of the first member 61 and the second member 70 may be reversed from those shown in the exemplary embodiment (i.e. second member 70 mounted on first ledge 52 and first member 61 mounted on second ledge 56) it is advantageous to mount the second member 70 with the opening of recess 76 facing downward to prevent the accumulation of water or other material.

The multiple piece shower stall 10 of the present disclosure is configured for installation within an alcove that has been framed out using ordinary building construction methods. The base 20 is positioned within the framed location so that it is level, plumb, and square. After the base 20 has been properly positioned in the desired location, the base 20 may be attached to frame members, such as wood or steel wall studs, by drilling holes in the attachment flange 54 and securing the attachment flange 54 to the frame members with suitable fasteners such as screws or nails.

The middle wall section 30 is then "dry-fit" to the base 20 to ensure proper alignment before permanent installation. The middle wall section 30 is positioned with the second ledge 56 above the first members 61 mounted on the first ledge 52 of the base 20. The middle wall section 30 is then positioned such that recesses 76 are located over the first sections 62. Middle wall section 30 is then lowered so that sections 62 of first members 61 mate within recesses 76 of second members 70 and surfaces 82 and 84 mate producing an audible "click" sound. With the middle wall section 30 in place on top of the base 20, middle wall section 30 is checked to assure that it is level, plumb, and square with the base 20 and to assure that middle section sidewalls 34, 36, and 38 are aligned with base sidewalls 24, 26, and 28, respectively. After assuring proper fit, middle wall section 30 is removed and the first ledge 52 and the second ledge 56 are cleaned so that they are free of dirt and other materials. A thin (approximately ⅛-inch wide) bead of sealant 90 is positioned along the first ledge 52 adjacent to first sections 62, as shown in FIG. 2. It is desirable that the sealant 90 be a high-grade silicone based adhesive caulk containing anti-microbial additives to resist the growth of mold and mildew. At the ends of first ledge 52 a bead of sealant should also be applied extending to attachment flange 54. However, sealant should not be applied to the pegs 62 or the receivers 70 as this may compromise the connection. Middle wall section 30 is then repositioned as described above. The middle wall section should be checked to verify that it is level, plumb, and square, as described previously with respect to the base 20. After the middle wall section 30 is in position on the base 20, any excess sealant should be removed. The attachment flange 54 of the middle section is then attached to the frame members as previously described, namely by drilling holes in the attachment flange 54 and securing the attachment flange 54 to the frame member with suitable fasteners such as screws or nails.

With the middle wall section 30 secured to the base 20 and to the frame, top wall section 40 is positioned and "dry-fit" with the middle section 30 to ensure proper fit and alignment before permanent installation as previously described. A bead of sealant is applied to the ledge 52 on the middle wall section 30, the top wall section 40 is mounted on the middle wall section 30 and attached to the wall frame members as previously described.

The multiple piece shower stall of the present disclosure facilitates joining separate sections of the shower stall by providing an interface between sections having connectors that allow positive placement and joining of the sections. The connectors facilitate positioning adjacent sections. Further, because the first and second members of the connection are magnetically coupled, a positive force is applied joining the sections. Also, upon mating of the first and second members, an audible "click" sound is produced, indicating to an installer that the sections are properly joined.

Although the present invention has been shown and described in detail, the same is to be taken by way of example only and not by way of limitation. Numerous modifications can be made to the disclosed embodiments without departing from the scope of the invention. For example, second members 70 of connectors 60 need not be cylindrical but rather can be any one of a number of desired shapes or configurations. The shape of first sections 62 of first members 61 can also be altered to ensure proper mating with the chosen configuration of second members 70. First members 61 of connectors 60 can also be secured to the shower stall sections by means other than a threaded connection. The first member 61 can include a magnet instead of or in addition to the magnet in second member 70. Other modifications can also be made without departing from the spirit and scope of the invention and of the appended claims.

I claim:

1. A multiple piece shower stall assembly including:

a base including a floor and a plurality of sidewalls extending upwardly from the floor;

a first wall section configured for mounting on the base, the first wall section including a plurality of sidewalls corresponding to the plurality of sidewalls of the base;

a first interface between the base and the first wall section, the first interface including a first ledge extending outwardly from the top of the sidewalls of the base and terminating in a first upwardly projecting flange and a second ledge extending outwardly from the bottom of the sidewalls of the first wall section and a plurality of connectors configured to join the first ledge and the second ledge;

a second wall section configured for mounting on the first wall section, the second wall section including a plurality of sidewalls corresponding to the plurality of sidewalls of the first wall section;

a second interface between the first wall section and the second wall section, the second interface including a third ledge extending outwardly from the top of the sidewalls of the first wall section and terminating in a second upwardly projecting flange, a fourth ledge extending outwardly from the bottom of the sidewalls of the second wall section and a plurality of connectors configured to join the third ledge and the fourth ledge;

wherein each connector includes a first member connected to one of the first ledge and the third ledge, the first member having a first section, a second member located within an aperture formed within one of the second ledge and the fourth ledge, the second member having a base, a sidewall extending from the base defining a recess and a magnet connected to the base within the recess, and wherein the first section of the first member and the second member are configured so that the first section fits within the recess.

2. The multiple piece shower stall assembly of claim 1, wherein at least the first section of the first member is made from a magnetic material.

3. The multiple piece shower stall assembly of claim 1, wherein at least the side wall of the second member of the connector is made from a magnetic material.

4. The multiple piece shower stall assembly of claim 1, wherein the first section of the first member includes a surface configured to contact a surface of the magnet.

5. The multiple piece shower stall assembly of claim 1, wherein at least two sidewalls of the base are integrally formed.

6. The multiple piece shower stall assembly of claim 1, wherein at least two sidewalls of the first wall section are integrally formed.

7. The multiple piece shower stall assembly of claim 1, wherein at least two sidewalls of the second wall section are integrally formed.

8. The multiple piece shower stall assembly of claim 1, wherein the shower stall is a tub and shower unit.

9. The multiple piece shower stall assembly of claim 1, further including a member located on one of the second ledge and the fourth ledge, the member including a recess for receiving at least a portion of the second member of the connector.

10. A multiple piece shower stall assembly comprising:

a base section including a floor and a plurality of sidewalls extending upwardly from the floor;

at least one wall section including a plurality of sidewalls corresponding to the plurality of sidewalls of the base section;

an interface between the base section and the wall section, the interface including a first ledge extending outwardly from the sidewalls of the base and a second ledge extending outwardly from the sidewalls of the wall section;

and a plurality of connectors configured to join the first ledge and the second ledge, at least one of the connectors having a first member connected to the first ledge and a second member connected to the second ledge, the second member including a base and a sidewall extending from the base defining a recess configured to receive a section of the first member.

11. The multiple piece shower stall assembly of claim 10, wherein the first and second members of the connector are magnetically coupled.

12. The multiple piece shower stall assembly of claim 10, wherein the first member includes a magnet.

13. The multiple piece shower stall assembly of claim 10, wherein the second member includes a magnet.

14. The multiple piece shower stall assembly of claim 10, wherein each connector further includes a magnet.

15. The multiple piece shower stall assembly of claim 10, wherein coupling the first member to the second member produces an audible sound.

16. The multiple piece shower stall assembly of claim 13, wherein the magnet includes a first surface and the first member includes a second surface configured to be in contact with the first surface of the magnet when the section of the first member is located in the recess of the second member.

17. The multiple piece shower stall assembly of claim 10, wherein at least one of the first member and the second member includes a threaded section for connecting the member to the first or second ledge.

18. The multiple piece shower stall assembly of claim 10, wherein at least one of the first member and the second member is located within an aperture in the first or second ledge.

19. The multiple piece shower stall assembly of claim 10, wherein at least a portion of the base of the second member is located above at least a portion of the first member.

20. The multiple piece shower stall assembly of claim 10, wherein at least two sidewalls of the base are integrally formed.

21. The multiple piece shower stall assembly of claim 10, wherein at least two sidewalls of the wall section are integrally formed.

22. The multiple piece shower stall assembly of claim 10, wherein the shower stall is a tub and shower unit.

23. The multiple piece shower stall assembly of claim 10, further including an aperture in the first ledge and a member located on the second ledge, the member including a recess, and wherein at least a portion of the second member extends through the aperture and into the recess.

24. A multiple piece shower stall assembly comprising:

a base section including a floor and a plurality of sidewalls extending upwardly from the floor;

at least one wall section including a plurality of sidewalls corresponding to the plurality of sidewalls of the base section;

an interface between the base section and the wall section, the interface including a first ledge extending outwardly from the sidewalls of the base and a second ledge extending outwardly from the sidewalls of the wall section; and a plurality of connectors configured to join the first ledge and the second ledge, at least one of the connectors having a first member connected to the first ledge and a second member connected to the second ledge and wherein coupling the first member to the second member produces an audible sound.

25. A multiple piece shower stall assembly comprising:

a base section having a wall;

a wall section having a wall;

an interface between the base section and the wall section, the interface including a first ledge and a second ledge;

a connector configured to join the first ledge and the second ledge, the connector having a first member connected to the first ledge and a second member connected to the second ledge, the second member including a base and a sidewall extending from the base defining a recess configured to receive a section of the first member.

26. The multiple piece shower stall assembly of claim 25, wherein the first and second members of the connector are magnetically coupled.

27. The multiple piece shower stall assembly of claim 25, wherein the first member includes a magnet.

28. The multiple piece shower stall assembly of claim 25, wherein the second member includes a magnet.

29. The multiple piece shower stall assembly of claim 25, wherein coupling the first member to the second member produces an audible sound.

* * * * *